United States Patent [19]

Miller

[11] 3,972,640

[45] Aug. 3, 1976

[54] HIGHWAY JOINT WITH SPRING TORSION BAR

[76] Inventor: Raphael W. Miller, 1406 W. Franklin St., Jackson, Mich. 49203

[22] Filed: Sept. 16, 1974

[21] Appl. No.: 506,470

[52] U.S. Cl. ..... 404/62; 404/60; 404/51; 404/40

[51] Int. Cl.[2] ..... E01C 11/14

[58] Field of Search ..... 404/47, 60, 50, 51, 404/53, 34, 62, 63, 52, 34, 40, 48

[56] References Cited

UNITED STATES PATENTS

| | | | |
|---|---|---|---|
| 1,279,431 | 9/1918 | Poulston | 404/63 |
| 1,987,392 | 1/1935 | Dill | 404/47 X |
| 2,127,973 | 8/1938 | Isett | 404/50 X |
| 2,262,677 | 11/1941 | Heltzel | 404/51 |
| 2,280,455 | 4/1942 | Seuberling | 404/48 |
| 2,365,550 | 12/1944 | Heltzel | 404/61 X |
| 2,552,365 | 5/1951 | Bradbury | 404/62 |
| 2,575,247 | 11/1951 | Carter | 404/60 |
| 2,608,142 | 8/1952 | Jacobson | 404/60 |
| 2,674,164 | 4/1954 | Brickman | 404/63 |
| 2,885,461 | 5/1959 | Cafiero | 404/58 X |
| 3,437,017 | 4/1969 | Walz et al. | 404/60 |
| R24,921 | 1/1961 | Wilbur | 404/51 |

*Primary Examiner*—Nile C. Byers, Jr.
*Attorney, Agent, or Firm*—Beaman & Beaman

[57] ABSTRACT

A highway joint system, and the method of forming the same, wherein bars are employed between adjacent concrete highway sections having obliquely disposed end joints imposing a biasing force upon the sections during the occurrence of section lateral displacement due to expansion. The joint system utilizes biasing bars which may employ torsion forces for realigning the highway sections after expansion thereof, and the system contemplates the utilization of a tongue and groove interconnection in conjunction with the bars to prevent "buckling" and other misalignment at concrete highway joints. A V-shaped divider plate is employed to define the tongue and groove relationship, and this plate supports the biasing bars, and is supported by a framework capable of releasable attachment to the bars.

4 Claims, 20 Drawing Figures

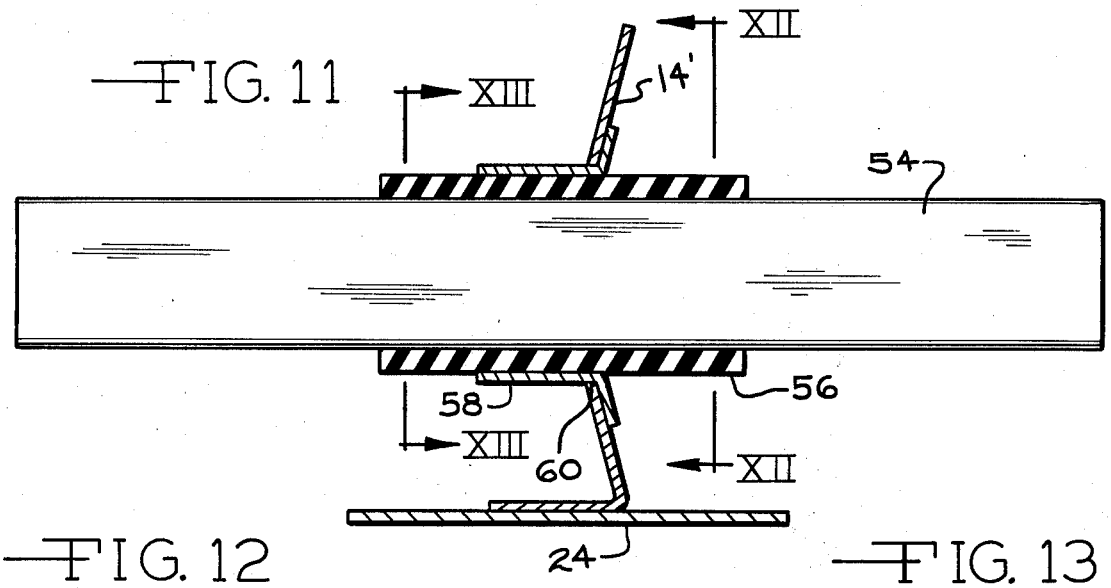
FIG. 11
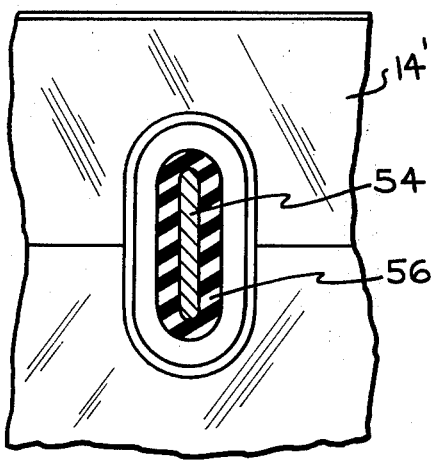
FIG. 12
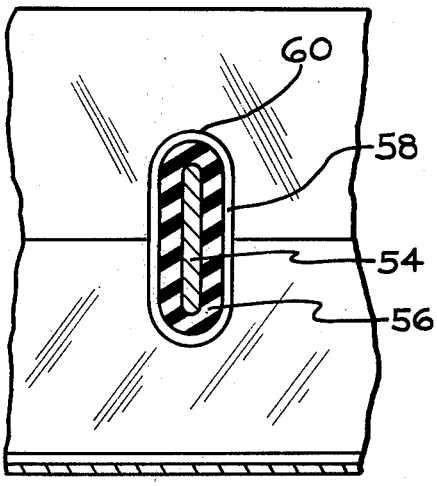
FIG. 13
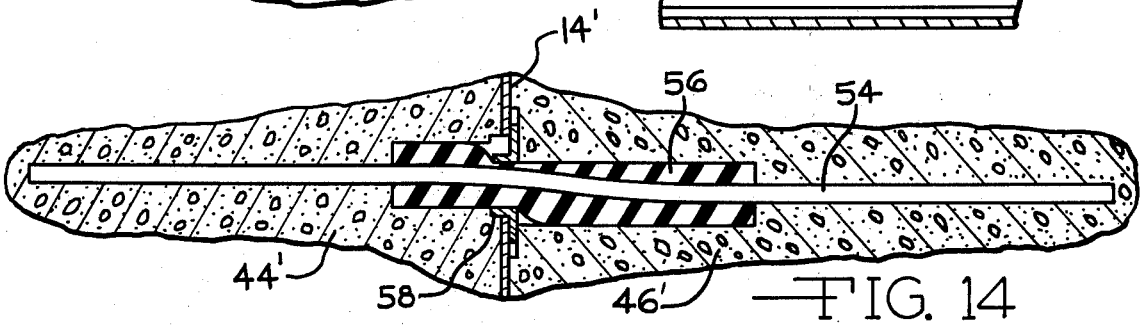
FIG. 14
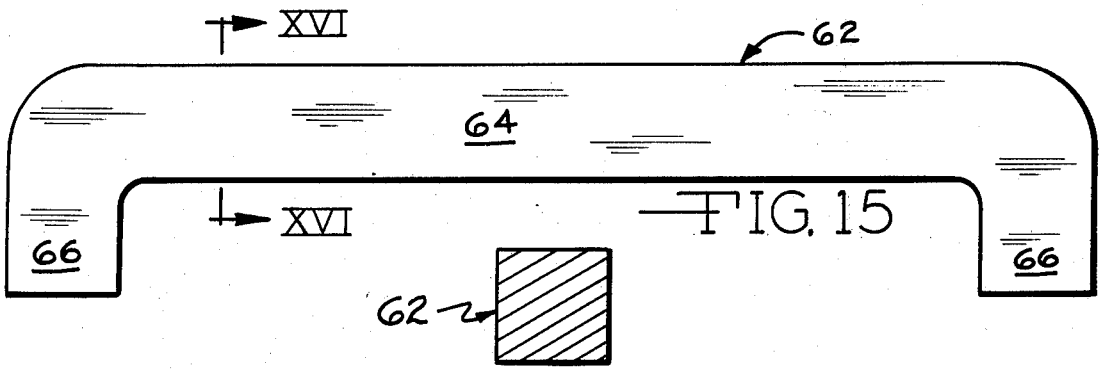
FIG. 15
FIG. 16

FIG. 17
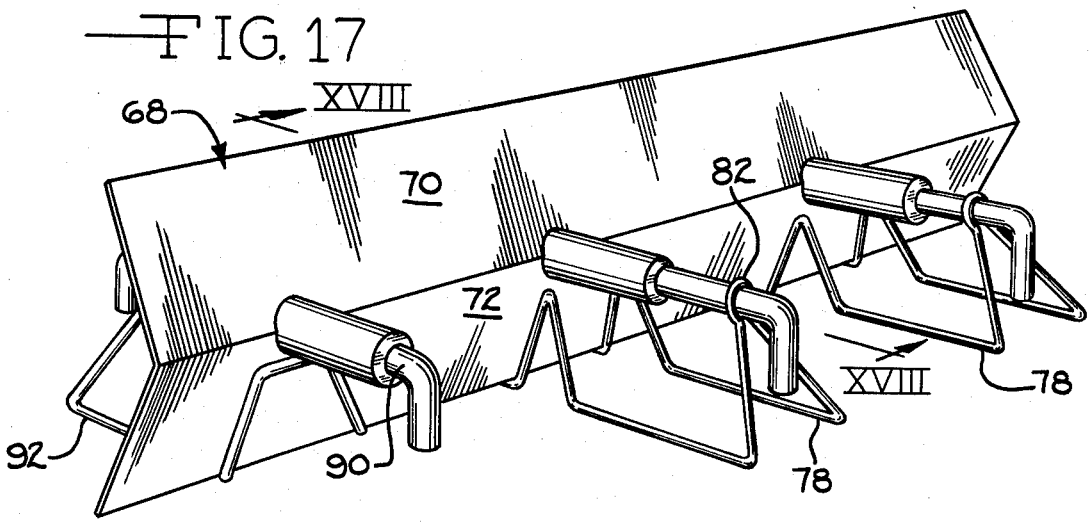
FIG. 18
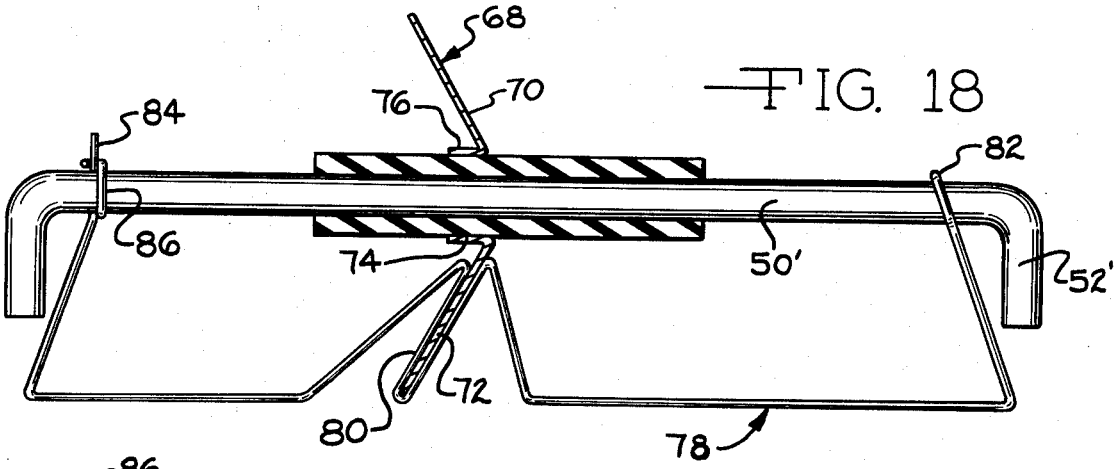
FIG. 20
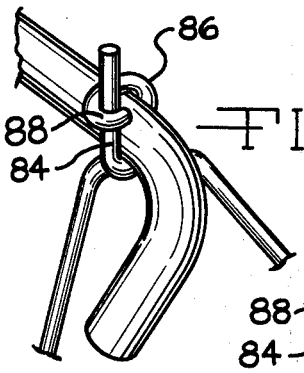
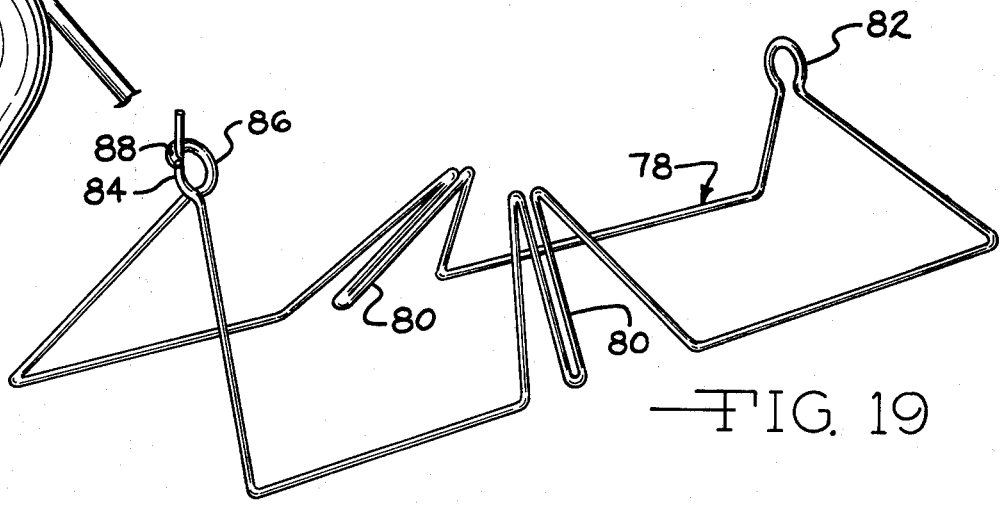
FIG. 19

HIGHWAY JOINT WITH SPRING TORSION BAR

BACKGROUND OF THE INVENTION

The invention pertains to concrete highway joint systems utilizing interconnecting embedded bars and other features to prevent misalignment of the joints during highway section expansion and contraction.

The majority of the nation's major highways, particularly those highways built for heavy high speed traffic, such as those included in the interstate system, are formed of concrete. Typical concrete highway construction includes the formation of a plurality of sections joined with an expansion joint perpendicularly disposed to the longitudinal length of the sections. It is known to use interlocking configurations at the highway section ends, and dowel bars, in order to prevent "buckling" and other misalignment problems that often occur as the highway sections expand and contract under temperature fluctuations. Considerable difficulty has been encountered in preventing damage to concrete highways due to such expansion and contraction, and the maintenance costs on concrete highways due to buckling, formation of cracks, and the like, amounts to many millions of dollars annually.

As mentioned above, the use of dowel bars to control the alignment of highway sections is known as shown in U.S. Pat. Nos. 2,106,095 and 2,262,677. Tongue and groove type joints have also been utilized as shown in U.S. Pat. Nos. 1,546,005; 1,571,700; 3,437,018 and 3,628,764. Further, tongue and groove joints employed in combination with dowel bars are known as shown in U.S. Re. Pat. No. 24,921, U.S. Pat. Nos. 3,143,783 and 3,785,741. However, the joint constructions of patents such as forementioned have not prevented those problems which have existed in concrete highway construction and the search for an improved joint has continued.

In the installation of divider plates between adjacent sections it is common to mount the plate upon a wire "basket" as shown in U.S. Pat. Nos. 2,308,677 and 2,296,195. However, such basket constructions require assembly and manufacture at a location remote from the site of use, and transportation and handling is expensive and troublesome.

While the majority of concrete highway joints are perpendicularly disposed to the length of the highway sections, it has been contemplated to obliquely relate the joints as shown in U.S. Pat. No. 1,740,345. However, such a construction, while reducing compressive forces, produces a lateral displacement of highway sections which has not heretofore been accceptable, or remedial.

SUMMARY OF THE INVENTION

It is an object of the invention to produce an improved concrete highway joint system utilizing a joint obliquely disposed to the length of the highway sections, and employing biasing means for maintaining alignment of the sections during contraction.

Another object of the invention is to provide an improved concrete highway joint system utilizing an obliquely disposed joint in conjunction with a tongue and groove relationship between adjacent sections which prevents relative vertical displacement between interrelated highway sections.

A further object of the invention is to provide an improved concrete highway joint system wherein the joint is obliquely disposed to the length of the highway sections, and employs biasing means in the form of dowel bars capable of resilient deflection wherein the dowel bars are provided with a clearance at their central region adjacent the joint in order to permit relative lateral deflection between the adjacent sections, yet the resilient nature of the bars realigns the sections during contraction, and such bars, particularly when used in conjunction with a tongue and groove connection, render the obliquely disposed joint acceptable as alignment is maintained under all conditions of expansion or contraction.

It is an additional object of the invention to provide a concrete highway joint system employing dowel bars wherein the dowel bars are in the form of torsion bars such that lateral displacement of adjacent sections produces a torsion force within the bars tending to realign laterally displaced sections during contraction of the sections.

A further object of the invention is to provide a divider plate for use in the construction of concrete highways which may be assembled with its supporting framework at the job site, thereby reducing manufacturing, assembly and transportation costs, and the dividing plate releasably supports dowel bars for ready assembly of the entire divider plate unit without special tools or skills.

Another object of the invention is to provide a method for interconnecting adjacent sections of concrete highway wherein the necessary contraction and expansion of the sections may occur without damage to the joints, and horizontal alignment of the sections is maintained at all temperature conditions.

BRIEF DESCRIPTION OF THE DRAWINGS

The aforementioned objects and advantages of the invention will be appreciated from the following description and accompanying drawings wherein:

FIG. 11 is an elevational, sectional view of a variation of configuration of dowel bar assembly, FIG. 12 is an elevational, sectional view of the embodiment of FIG. 11 as taken along section XII—XII of FIG. 11, FIG. 13 is an elevational, sectional view taken in FIG. 11 along section XIII—XIII, FIG. 14 is a top plan view of the embodiment of FIGS. 11 through 13, as embedded in concrete highway sections, and illustrating the deflection of the dowel bar member under lateral displacement of the highway section, FIG. 15 is an elevational view of another variation of dowel bar configuration having a square cross section configuration, FIG. 16 is a sectional view along XVI—XVI of FIG. 15, FIG. 17 is a perspective view of a divider plate assembly in accord with the invention illustrating a wire type supporting framework for the divider plate, FIG. 18 is an elevational, sectional view as taken along section XVIII—XVIII of FIG. 17, FIG. 19 is a perspective view of the divider plate supporting framework, per se, and FIG. 20 is an enlarged perspective detail view of the releasable attachment means of the divider plate supporting framework as associated with a dowel bar.

DESCRIPTION OF THE PREFERRED EMBODIMENTS

With reference to FIGS. 1 through 8, a concrete highway joint system in accord with the inventive concepts is obliquely disposed to the longitudinal length of the associated highway sections. As will be apparent in FIG. 6, the rails 10 define the edges of the aligned highway sections, and during pouring of the sections the concrete laying equipment travels on the rails. The joint assembly, generally indicated at 12, is disposed between the rails 10 at an angle obliquely related to the length of the resultant highway section, and this angle of obliqueness may be approximately 45°, as illustrated.

Figure 7:
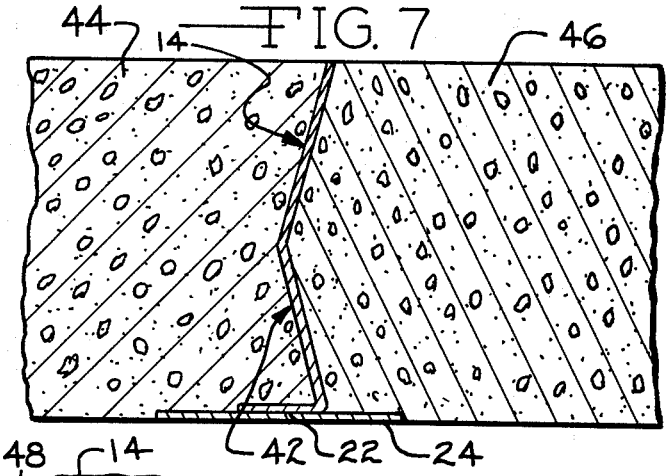
FIG. 7 is a cross-sectional, elevational view as taken through a highway joint constructed in accord with the invention after pouring of the highway section.

The highway joint assembly 12 includes a divider plate 14 formed of sheet metal, and of a V-shaped configuration although mounted upon it side, as apparent in FIG. 7. In the illustrated embodiment the plate includes sections 16 and 18 intersecting at an apex 20, and the section 18 includes a depending portion 22 affixed to a base plate 24 for supporting the assembly during pouring. As is appreciated from FIGS. 1 and 6, the ends 26 of the plate are angled to accommodate the oblique relationship between the rails 10, and the ends 26 will be disposed parallel to the length of the highway sections.

A plurality of openings 28 are defined in the divider plate 14 evenly spaced along the length thereof. The openings symmetrically intersect the apex 20, and receive dowel bar supporting sleeves 30 which include a cylindrical tubular portion 32, and obliquely disposed flange 34, FIG. 2. The flanges may be spot welded, or otherwise affixed to the divider plate.

A dowel bar is associated with each opening 28 and sleeve 30. The illustrated dowel bars 36 in FIGS. 1 through 8 are of a cylindrical configuration in the form of a linear rod. These bars each include a central region 38 located adjacent the divider plate and sleeve 30. It is desired that the central region of the bars 36 be spaced from the concrete in which the bars are embedded, and for this purpose a yieldable jacket 40 is closely received upon the dowel bars' central region 38, and closely received within the supporting sleeve portion 32. In the disclosed embodiment the jackets 40 are formed of an elastomer material, such as rubber or neoprene, and is of such length as to extend 3 or 4 inches on either side of the divider plate 14.

Figure 1:
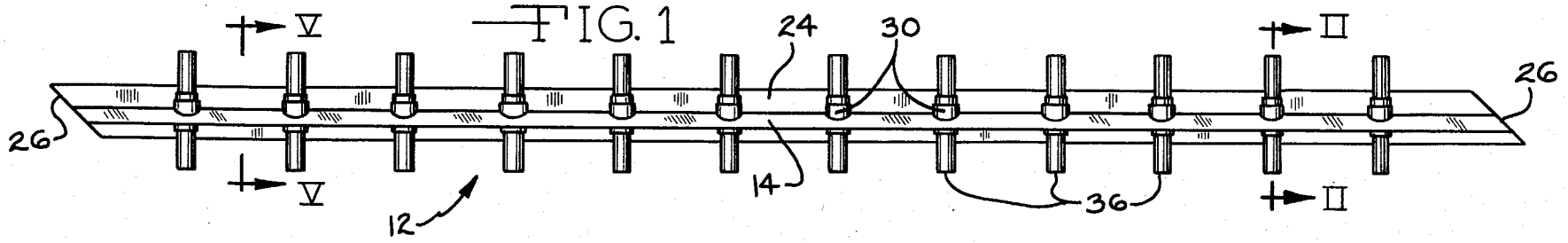
FIG. 1 is a top plan view of a concrete highway joint divider plate as constructed in accord with the invention.
Figure 2:
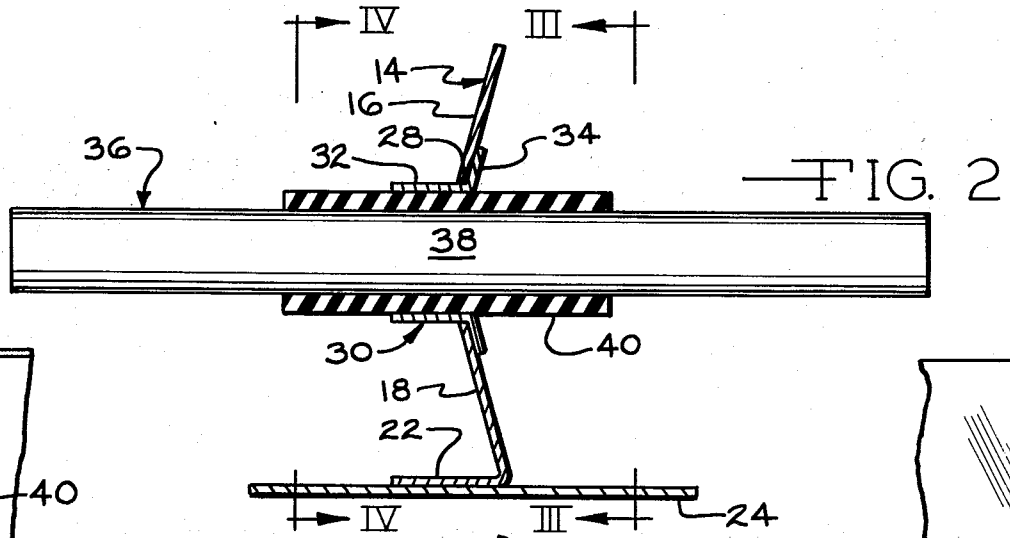
FIG. 2 is an elevational, sectional view as taken along section II—II of FIG. 1.
Figure 3:
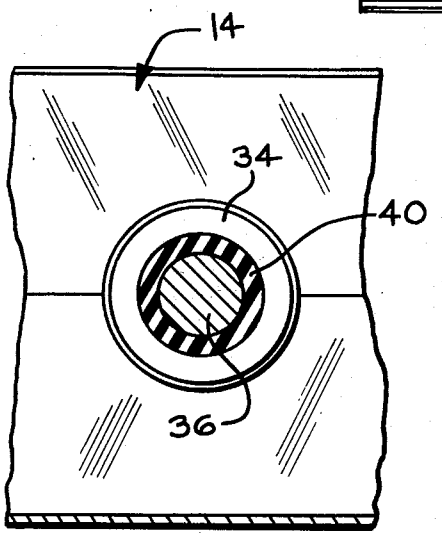
FIG. 3 is an elevational, sectional view as taken along section III—III of FIG. 2.
Figure 4:
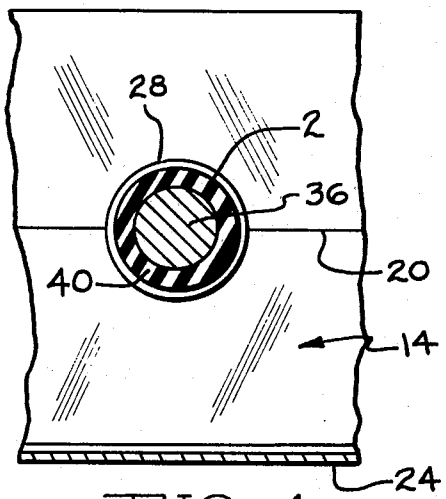
FIG. 4 is an elevational, sectional view as taken through the dowel bar and other divider plate structure along section IV—IV of FIG. 2.
Figure 5:
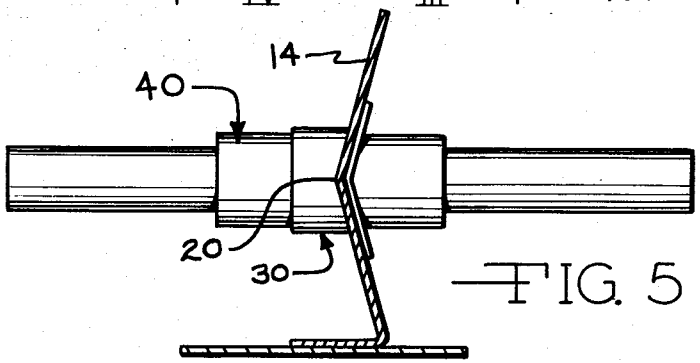
FIG. 5 is an elevational, sectional view of the joint assembly as taken along section V—V of FIG. 1.
Figure 6:
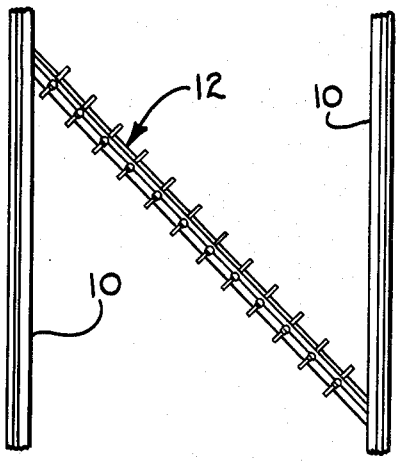
FIG. 6 is a top plan view of the orientation of the joint divider plate between the rails of the highway section to be formed.

In use, divider plates 14 may be shipped without the dowel bars and jackets assembled thereto, and these components may be assembled at the site of the use. The entire joint structure is assembled as shown in FIG. 1, and related to the rails 10 in the manner shown in FIG. 6. Upon the pouring of concrete on each side of the highway joint 42 the dowel bars 36 will be embedded into the concrete adjacent the ends of the highway sections 44 and 46, and a clearance 48 will be defined between the central region of the dowel bars and the adjacent concrete due to the existence of the resilient jackets 40.

Figure 8:
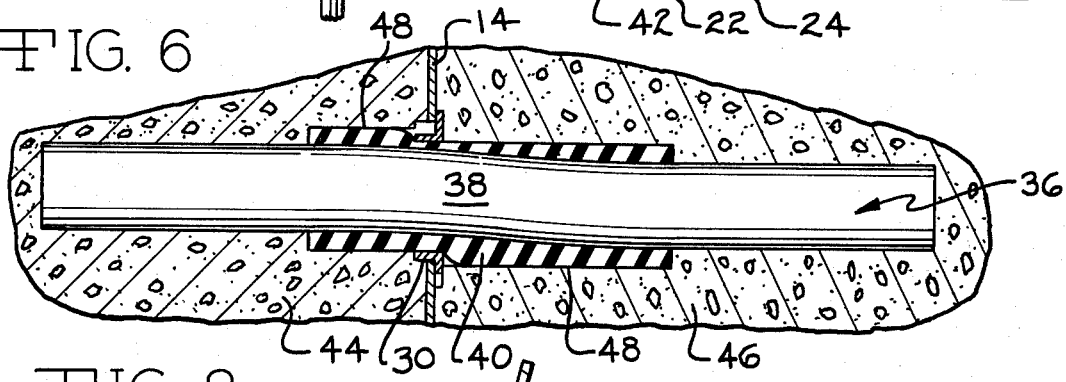
FIG. 8 is a top plan view of a detail of a highway joint in accord with the invention illustrating the deflection of the dowel bars under relative lateral displacement of the highway sections.

As the highway sections 44 and 46 longitudinally expand, the oblique orientation of the joints 42 will cause the sections to be laterally displaced relative to each other. A tongue and groove relationship between the sections 44 and 46 results from the V-shaped configuration of the divider plate 14 and, together with the dowel bars, will prevent the joint sections from being relatively vertically displaced during such lateral deflection, and the lateral deflection will produce a deflection within the central region 38 of the dowel bars 36, as will be appreciated from FIG. 8. Of course, the deflection illustrated in FIG. 8 is magnified for purpose of illustration.

The dowel bars 36 impose a biasing force on the highway sections 44 and 46 endeavoring to realign the sections, such that during contraction of the sections as the temperature decreases, the biasing force imposed upon the sections by the dowel bars realigns the sections and assures that the joint 42 will not "open".

Due to the presence of the yieldable jackets 40 defining a "clearance" between the central region of the dowel bars and the concrete, the central regions of the dowel bars are free to deflect in the intended manner so as to provide the desired biasing action. However, a sufficient portion of the end regions of the dowel bars is embedded in the concrete to securely anchor the dowel bars to their respective highway sections so that the biasing forces imposed upon the dowel bars may be effectively transmitted to the sections for realignment purposes.

Figure 9:
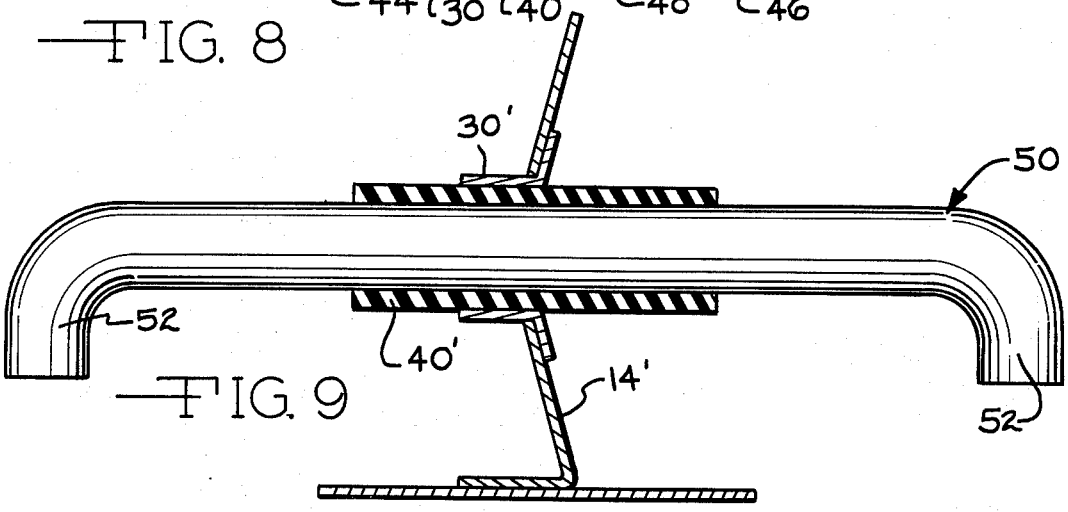
FIG. 9 is an elevational, sectional view of a variation of highway joint assembly in accord with the invention illustrating a torsion bar dowel.
Figure 10:
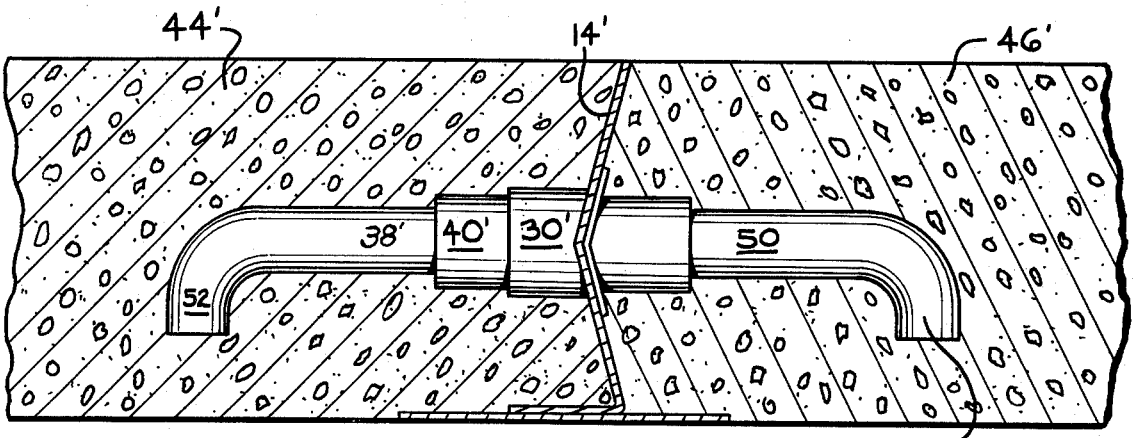
FIG. 10 is an elevational, sectional view of the embodiment of FIG. 9 as embedded in concrete highway sections.

The embodiment of FIGS. 9 and 10 is similar in many respects to the previously described embodiment and like components are identified by primes. The dowel bar 50 shown in FIGS. 9 and 10 is preferably of a cylindrical configuration, and differs from the previously described dowel bar embodiment in that the end regions are each bent to provide a transversely extending portion 52 transversely disposed to the longitudinal length of the bar, and the associated central region.

When the dowel bar 50 is embedded in the concrete highway sections 44′ and 46′, the transversely disposed portions 52 cause a torsional force to be imposed on the bars as lateral deflection of the highway sections occurs. The portions 52 of a common bar are disposed in a like direction, usually downwardly, and thus an effective torsional force is produced in the dowel bars due to lateral section highway displacement to produce significant torsional forces within the central region 38′ to effectively bias the sections 44′ and 46′ to a realigned position during contraction. Thus, it will be appreciated that the dowel bars 50 function as torsion bars to produce the biasing force on the highway sections.

In the embodiment of FIGS. 11 through 14 similar components to those previously described are also indicated by primes. In this embodiment the dowel bar is in the form of a leaf spring 54, and accordingly, the elastomer jacket 56, sleeve 58 and opening 60 are of an elongated cross-sectional configuration to accommodate the configuration of the leaf spring 54. The dowel spring 54 will deflect as shown in FIG. 14 upon lateral displacement of the highway sections 44' and 46', and the dowel springs will usually be formed of a high strength spring steel. In this embodiment the realigning biasing forces, installation and assembly is similar to that of the previously described embodiments.

FIGS. 15 and 16 describe a variation in the form of a torsion bar 62 having a central region 64 and transversely disposed end portions 66. In these figures the torsion bar 62 is of a rectangular transverse cross-sectional form, and the inventive concepts are identical to those previously described. Accordingly, regardless of the cross-sectional configuration of the dowel bars, the associated elastomer jacket, supporting sleeve and divider plate opening, will be complementary in order to provide the desired structural relationships.

In FIGS. 17 through 20 a variation of the inventive concept is illustrated utilizing a wire framework for supporting the divider plate and dowel bars. In this embodiment the divider plate 68 is of a V-shaped configuration having an upper portion 70 and a lower portion 72. The openings 74 are defined by a lanced flange 76 which serves to provide adequate support of the central region of the torsion bar dowel bars 50' through the elastomer jacket 40'.

The dividing plate 68, and dowel bars 50', are supported by a plurality of supporting frameworks 78 formed of wire. These frameworks are best illustrated in FIGS. 18 and 19 and include a central portion 80 having a spaced configuration which closely receives the dividing plate lower portion 72, FIG. 18. The framework extends to one side of the dividing plate and is formed with an eye 82 for receiving one end of the dowel bar 50'. The other portion of the framework extends to the opposite side of the dividing plate 68 and the ends are formed as shown in FIGS. 19 and 20 to include an offset portion 84, and a curved poriton 86 terminating in a hook 88. the portions 84 and 86 are adapted to form an eye when encircled about the dowel bar as shown in FIG. 20. The hook 88, and the dimensions of the offset end 84 are such that by deflecting the portions 84 and 86 the portions may be released from each other and from the dowel bar, or manually assembled thereto. This construction permits the dividing plate 68, dowel bars 50', elastomer jackets 40' and frameworks 78 to be shipped to the site of use separately, and the entire unit assembled at the site, experiencing a substantial shipping advantage over more conventional preassembled concrete highway joint assemblies.

The endmost dowel bars 90 located in the divider plate 68 are preferably of a shorter length than the other dowel bars in view of the proximity of these dowel bars to the edge of the highway section. Accordingly, such reduced length dowel bars may be supported by a wire framework 92 which constitutes "half" of the framework 78 disclosed, and such a framework is partially shown at the left of FIG. 17.

In each of the embodiments of the invention, the dowel bar is formed of a steel having suitable resiliency and deflection characteristics to serve the desired purpose. The dimensions lengthwise and diameterwise, and the physical characteristics of the dowel bars may vary with respect to the preferences of the highway designer, thickness of highway section, and other factors, and it is appreciated that various modifications within the scope of the inventive concept may be apparent to those skilled in the art without departing from the purpose and scope of the invention.

I claim:

1. A concrete highway joint system comprising, in combination, substantially planar adjacent concrete highway sections having abutting ends defining a joint, said ends being obliquely disposed in a horizontal direction with respect to the length of said sections, a plurality of deflectible, resilient, elongated biasing members embedded in said sections each having end regions exposed to the concrete and a central region, said end regions of a common biasing member being embedded in different sections and said central region being located adjacent and bridging said joint on each side thereof, said elongated biasing members comprising torsion bars, said end regions being transversely disposed to the associated central region in a direction transverse to the plane of said highway sections whereby relative lateral displacement of said highway sections produces a torsional force within said central regions, and a substantial radial clearance defined between said concrete sections and said bars' central region by an annular resilient jacket encompassing said biasing members' central region permitting lateral bending of said regions with respect to the length of said members and a relative internal displacement of adjacent sections, said clearance being sufficient to permit said central region bending without damaging the concrete of said sections adjacent said joint.

2. A dowel bar for concrete highway joints comprising, in combination, an elongated member of steel having a predetermined elasticity, said member having a central region and exposed end regions transversely disposed to said central portion wherein said member comprises a torsion bar, and a resilient yieldable jacket formed of an elastomer encompassing said central portion having a length and radial wall thickness sufficient to permit transverse bending of said end regions relative to said central region within the elastic limits of said member when said bar is entirely embedded in concrete.

3. A divider for substantially planar concrete highway sections comprising, in combination, an elongated plate of V cross-sectional configuration defining an apex, a plurality of tubular openings defined in said plate spaced along the length thereof and extending through said apex, said openings comprising dowel bar support means having an axis perpendicular to the length of said plate, a bendable dowel bar supported within each of said openings having a central region located within the associated opening and end regions disposed on opposite sides of said plate, said dowel bar end regions being transversely disposed to said central regions in a direction transverse to the plane of said highway sections, said bars constituting torsion bars, a tubular jacket of yieldable material encompassing said bar's central region only snugly received within the associated tubular opening and extending from each side of said associated opening defining a clearance between said central region and the concrete of the associated highway sections when said divider is embedded therein permitting lateral bending of said dowel bars in said central region, and plate support means for supporting said plate wherein said V configuration is disposed upon its side to form a tongue and groove joint between adjacent highway sections, said plate support means comprising a framework engaging said plate and having a bar support extending beyond at least one side of said plate, said bar support defining an eye encircling the end region of a bar and including a releasable connection for releasable attachment to a dowel bar adjacent an end region comprising a first member partially defining an eye having a hook end region and a second member defining the remainder of an eye having an extended end region adapted to be received within said hooked end region whereby said first and second members together define a releasable dowel bar encircling eye.

4. the method of interconnecting concrete highway sections having abutting ends defining a joint obliquely disposed in a horizontal direction to the length of the sections with a plurality of elongated torsion bars each having end regions and a central region, said end regions including torsion producing elements transversely disposed to the length of the associated bar for providing a torsion force within the associated bar upon lateral displacement of adjacent highway sections, comprising the steps of embedding a plurality of elongated torsion bars in adjacent sections bridging the joint wherein the central region of said bars extends through the joint, and defining a clearance between said bars' central region and the concrete of said sections adjacent the joint sufficient for permitting lateral displacement of adjacent sections at the joint without damage to the concrete of said sections and permitting deflection of said bars at said central regions with respect to said end regions.

* * * * *